US006458051B1

(12) United States Patent
Moore

(10) Patent No.: US 6,458,051 B1
(45) Date of Patent: Oct. 1, 2002

(54) STATIONARY BLOCKING/TACKLING PLATFORM FOR FOOTBALL

(76) Inventor: Thomas S. Moore, 2608 E. 300 N., Layton, UT (US) 84040

( * ) Notice: Subject to any disclaimer, the term of this patent is extended or adjusted under 35 U.S.C. 154(b) by 0 days.

(21) Appl. No.: 09/865,587

(22) Filed: May 29, 2001

(51) Int. Cl.[7] ..... A63B 69/34; A63B 67/00
(52) U.S. Cl. ..... 473/445; 473/441; 473/422
(58) Field of Search ..... 473/445, 441, 473/438, 422, 444

(56) References Cited

U.S. PATENT DOCUMENTS

| | | | | |
|---|---|---|---|---|
| 2,255,711 | A | * | 9/1941 | Noor |
| 2,440,577 | A | * | 4/1948 | Denby |
| 2,653,816 | A | * | 9/1953 | Young et al. |
| 2,934,343 | A | * | 4/1960 | Schumacher |
| 3,216,724 | A | * | 11/1965 | Williams |
| 3,218,070 | A | | 11/1965 | Crowther |
| 3,467,380 | A | * | 9/1969 | Bonacci |
| 3,578,324 | A | | 5/1971 | Alvey et al. |
| 3,674,265 | A | | 7/1972 | Sheets et al. |
| 3,684,283 | A | * | 8/1972 | Forrest |
| 3,825,260 | A | * | 7/1974 | Thomas, Sr. |
| 3,889,949 | A | | 6/1975 | Gardner |
| 3,897,060 | A | | 7/1975 | Jennings |
| 3,997,160 | A | * | 12/1976 | George |
| 4,140,315 | A | * | 2/1979 | Page, Jr. |
| 4,477,076 | A | * | 10/1984 | Monaco |
| 4,508,341 | A | * | 4/1985 | Carrington |
| 4,736,947 | A | * | 4/1988 | Jenkins |
| 4,802,670 | A | | 2/1989 | Smith |
| 4,943,057 | A | | 7/1990 | Felder |
| 5,385,523 | A | * | 1/1995 | Forrest |
| 6,261,194 | B1 | * | 7/2001 | Hadar et al. |

FOREIGN PATENT DOCUMENTS

| | | |
|---|---|---|
| CA | 1030572 | 5/1978 |
| CA | 1045646 | 1/1979 |
| FR | 2 541 122 | 8/1984 |
| GB | 2 031 737 A | 4/1980 |

* cited by examiner

*Primary Examiner*—Paul T. Sewell
*Assistant Examiner*—Nini F. Legesse
(74) *Attorney, Agent, or Firm*—Richard C. Litman

(57) ABSTRACT

A stationary blocking/tackling platform for football comprising up to seven parallel blocking/tackling padded dummies movable along a track and returnable to the original position. The sled is suitable for football player training ranging from junior high school to the professional ranks.

10 Claims, 4 Drawing Sheets

STATIONARY BLOCKING/TACKLING PLATFORM FOR FOOTBALL

BACKGROUND OF THE INVENTION

1. Field of the Invention

The present invention relates generally to sports training equipment. More specifically, the invention is a stationary blocking and tackling platform for a football program suitable from junior high school to professional football.

2. Description of the Related Art

The related art of interest describes various football blocking sleds and tackling machines, but none discloses the present invention. There is a need for an economical but efficient stationary football blocking/tackling platform suited for players ranging from junior high school to professional, wherein the platform remains stationary while the tackling or blocking pad moves from s first end of the sled to the opposite end. The platform can be designed so that a second player can hit the blocking/tackling pad at the opposite end and drive it back to the first end. Moreover, multiple platforms can be placed together side-by-side so that a group of players can line up and be instructed to hit their padded dummies on command by the coach. The related art will be discussed in the order of perceived relevance to the present invention.

Canadian Patent Application No. 1,045,646, published January, 1979, describes a football training aid comprising an elongated fixed horizontal track, a carriage adapted to be moved in the track along a predetermined distance and being biased against movement by a spring, an upright support member mounted on an underground carriage, and a padded football player dummy mounted on the upright support to thereby apply reactive pressure against the rush of the football player in the biased direction. The dummy can be thrown to either side and twisted about a vertical axis. The apparatus is distinguishable for requiring a buried resistive spring and the capability of the dummy to be maneuvered in various directions.

U.S. Pat. No. 4,802,670 issued on Feb. 7, 1989, to Dan R. Smith describes a football blocking apparatus having a telescoping ram assembly supported on a movable sled with a height adjustment. A rectangular blocking pad positioned vertically is attached to the end of the ram having a projecting thrust bar for imparting thrust forces to selectively extend or retract the telescoping ram assembly to simulate the rush of a lineman. The blocking pad can be positioned horizontally to simulate a cut block. The blocking apparatus is distinguishable for requiring a thrust bar subassembly on a movable-sled.

U.S. Pat. No. 4,943,057 issued on Jul. 24, 1990, to James G. Felder describes a torsion-imparting blocking practice sled having a spring to yield blocking pressure and to impart torsional forces for greater practice realism with a helical rod traversing an L-shaped metal frame having a toothed bushing and attached to a slide block. A cupped blocking pad is attached to the opposite end of the helical rod. The apparatus is distinguishable for requiring a torsional system on a movable sled.

U.S. Pat. No. 3,674,265 issued on Jul. 4, 1972, to Harry L. Sheets et al. describes a football blocking and tackling sled comprising a vertical pad coupled to a first set of compression springs on a forward end of a plunger slidable within a hollow guide sleeve. A latch mechanism holds the plunger in its retracted position. An expansion spring inside the sleeve urges the plunger outward. The forward motion of the plunger is limited by a second set of compression springs, and a third set of compression springs limit the rearward motion. A plurality of devices may be connected together so that a common release mechanism releases the latch release of all devices simultaneously. The guide sleeve is supported by vertical support pipe members welded to a rectangular pipe base which is a movable sled. The apparatus is distinguishable for requiring a multitude of springs and a sled base.

U.S. Pat. No. 3,897,060 issued on Jul. 29, 1975, to Ralph E. Jennings describes a football blocking apparatus on a sled with timing and indicator means to measure a blocker's performance. The sled base consists of two parallel channel bars joined by two channel crossbars to support the coil springs attached to the pad. A hydraulic cylinder with a two-way check valve is employed to damp the forward movement of the apparatus. The apparatus is distinguishable for requiring a sled, a hydraulic cylinder and a two-way check valve.

U.S. Pat. No. 3,889,949 issued on Jun. 17, 1975, to John E. Gardner describes a football blocking sled consisting of an upright frame supported by two parallel runners in the form of skis. A coach stands on a platform to vertically move a pair of blocking pads within the frame. The apparatus is distinguishable for requiring a movable sled with vertically moving blocking pads.

U.S. Pat. No. 3,218,070 issued on Nov. 16, 1965, to Rae Crowther describes a foldable football practice apparatus comprising a blocking pad supported by a forwardly bowed leaf spring supported on a frame attached to a wall. The apparatus is distinguishable for its required attachment to a wall.

U.S. Pat. No. 3,578,324 issued on May 11, 1971, to George H. Alvey et al. describes a football practice apparatus comprising a fixed or movable base supporting an upright square beam having a bent control arm pivoting at its top end, held in position by a lock member, and supporting a horizontal notched rod having a disc at its end, and passing through the upright beam. Two parallel horizontal slidable rods with compressive springs are attached to a vertical support channel element to support an upright blocking pad. The notched rod offers resistance to the blocking force and can be reset by the control arm. The apparatus is distinguishable for its unique structure.

Canadian Patent Application No. 1,030,572, published May, 1978, describes a football blocking pad supported by two parallel runners which support a blocking pad on an inclined brace which can rotate the telescoping tubes supporting the pad upward. The apparatus is distinguishable for requiring a sled and a telescoping resistive rod supporting the pad.

U.K. Patent Application No. 2 031 737 A published on Apr. 30, 1980, for John H. Sheppard describes an effort measuring apparatus for measuring scrummaging practice for rugby football. The apparatus comprises a frame with a scrummaging aid able to move along a pair of parallel rails on wheels. The frame is fixed to the floor by feet. A piston and cylinder unit positioned between the rails resists the pressure applied to the frame by the rugby player. A pressure gauge measures the pressure exerted. A pump and bleed-off valve allows the pressure of the piston and cylinder to be modified. The apparatus is distinguishable for requiring hydraulic pressure to supply the resisting force and anchoring the apparatus on a floor.

France Patent Application No. 2 541 122 published on Aug. 24, 1984, for Pierre Gerard describes a movable training "wall" apparatus comprising a plurality of oscillating aligned dummies for football players during training for shots at a goal with a ball on a football pitch. The dummies can pivot on a shaft mounted on a movable frame on four wheels which can be locked. The apparatus is distinguishable for its distinctly different structure requiring pivotable dummies.

None of the above inventions and patents, taken either singularly or in combination, is seen to describe the instant invention as claimed. Thus, a blocking sled for football solving the aforementioned problems is desired.

SUMMARY OF THE INVENTION

The present invention is directed to a stationary blocking/tackling platform for football players comprising up to seven joined-in-parallel platforms with blocking/tackling pads movable along its individual track and returnable to the original position. Thus, two players at opposite ends of the track can train on one dummy pad. The dummy pad is inclined towards the player for blocking and rotatable on its bent post by a connecting pin. The rod supported dummy pad rides on two wheels in a track offering resistive force by a pair of buried side panels having pressure applied by a series of springs from opposite sides. The stationary platform is suitable for football player training ranging from junior high school to the professional ranks and can be used indoors or outdoors.

Accordingly, it is a principal object of the invention to provide a stationary blocking/tackling platform for training football players.

It is another object of the invention to provide a stationary blocking/tackling platform which allows two players to practice on one padded dummy indoors or outdoors.

It is a further object of the invention to provide a stationary blocking/tackling platform which is capable of having the resistive pressure by the padded dummy adjustable.

Still another object of the invention is to provide a group of at least 7 stationary blocking/tackling platforms joined and aligned for instructing a group of football players to hit the pads simultaneously upon command by the coach.

It is an object of the invention to provide improved elements and arrangements thereof for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

The present invention is directed to a stationary blocking and tackling platform for instructing football players to hit or tackle a blocking/tackling pad which moves along a track and which presents resistance to movement along the track.

Figure 1:
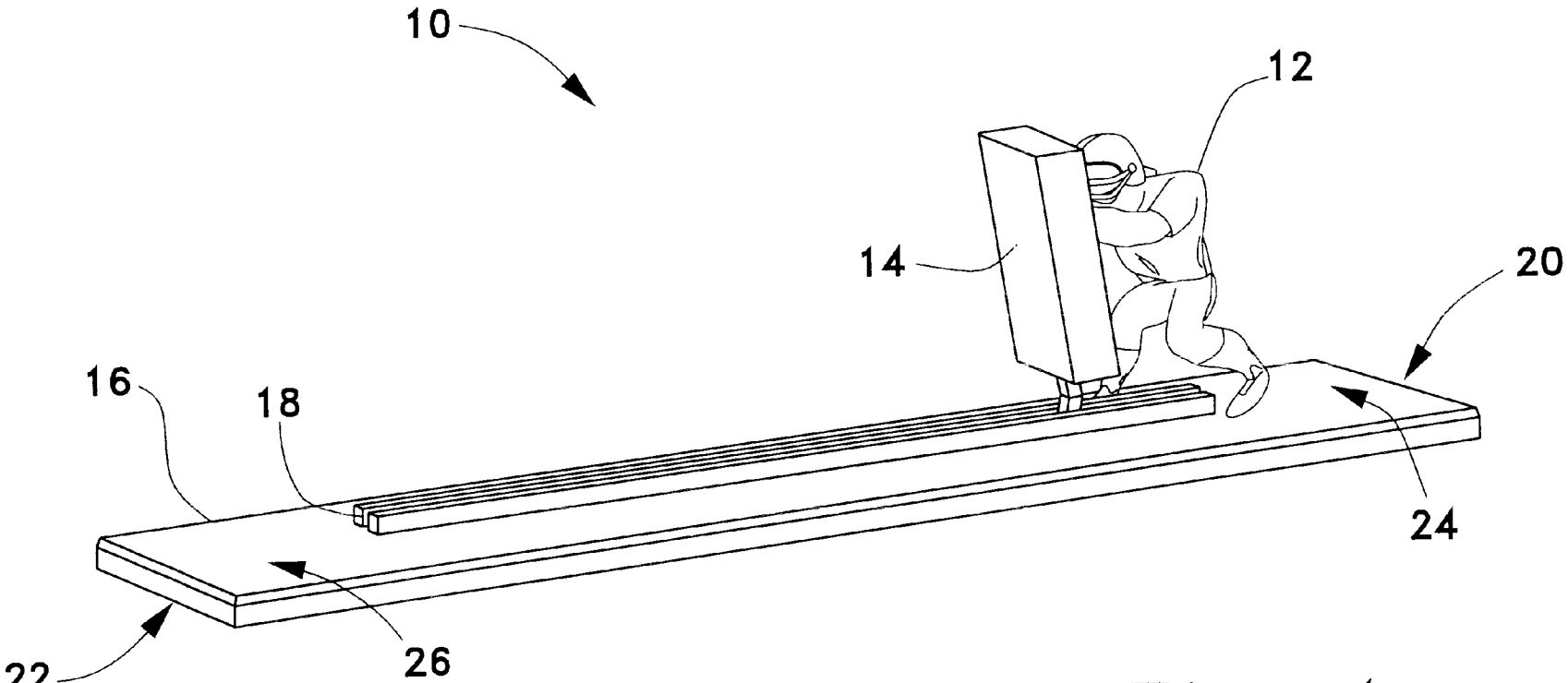
FIG. 1 is an environmental, perspective view of a blocking/tackling platform with a football player hitting the blocking/tackling padded dummy according to the present invention.
Figure 2:
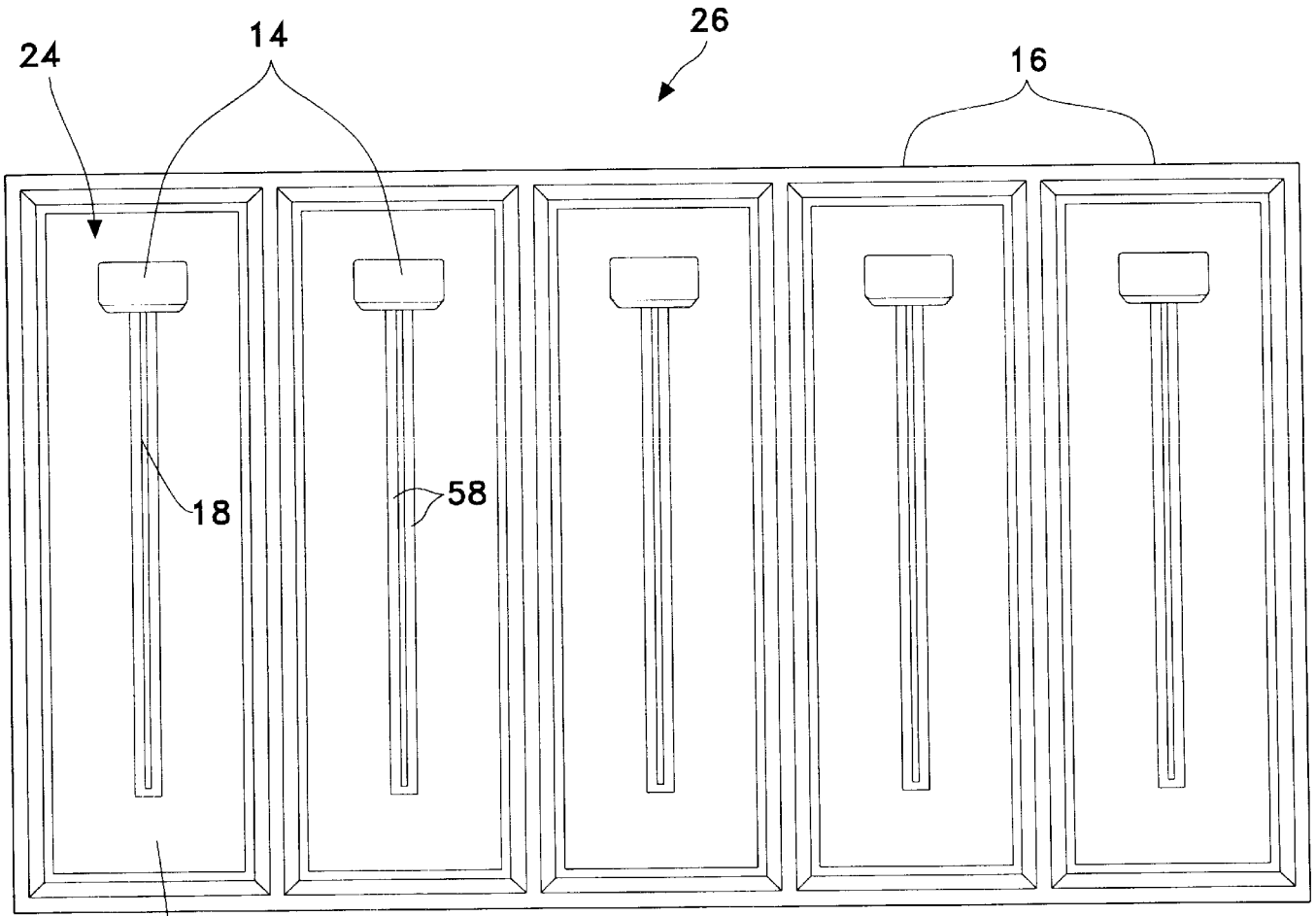
FIG. 2 is a plan view of a five-man platform formed by joining multiple platforms together according to a multiple version of the present invention.

In FIG. 1, a blocking/tackling platform embodiment 10 is being used by a football player 12 pushing a blocking/tackling padded dummy 14 having an elongated shape on a rectangular platform 16 having a central slotted track 18 spaced from a first end 20 and from a second end 22 of the platform 16. The end spaces 24 provide room for the player to step onto the platform 16 before making his run at the pad 14. FIG. 2 illustrates a combination of five platforms 26 connected side-to-side for enabling the training of up to ten athletes. However, it is preferred to have seven platforms 26 connected.

Figure 3:
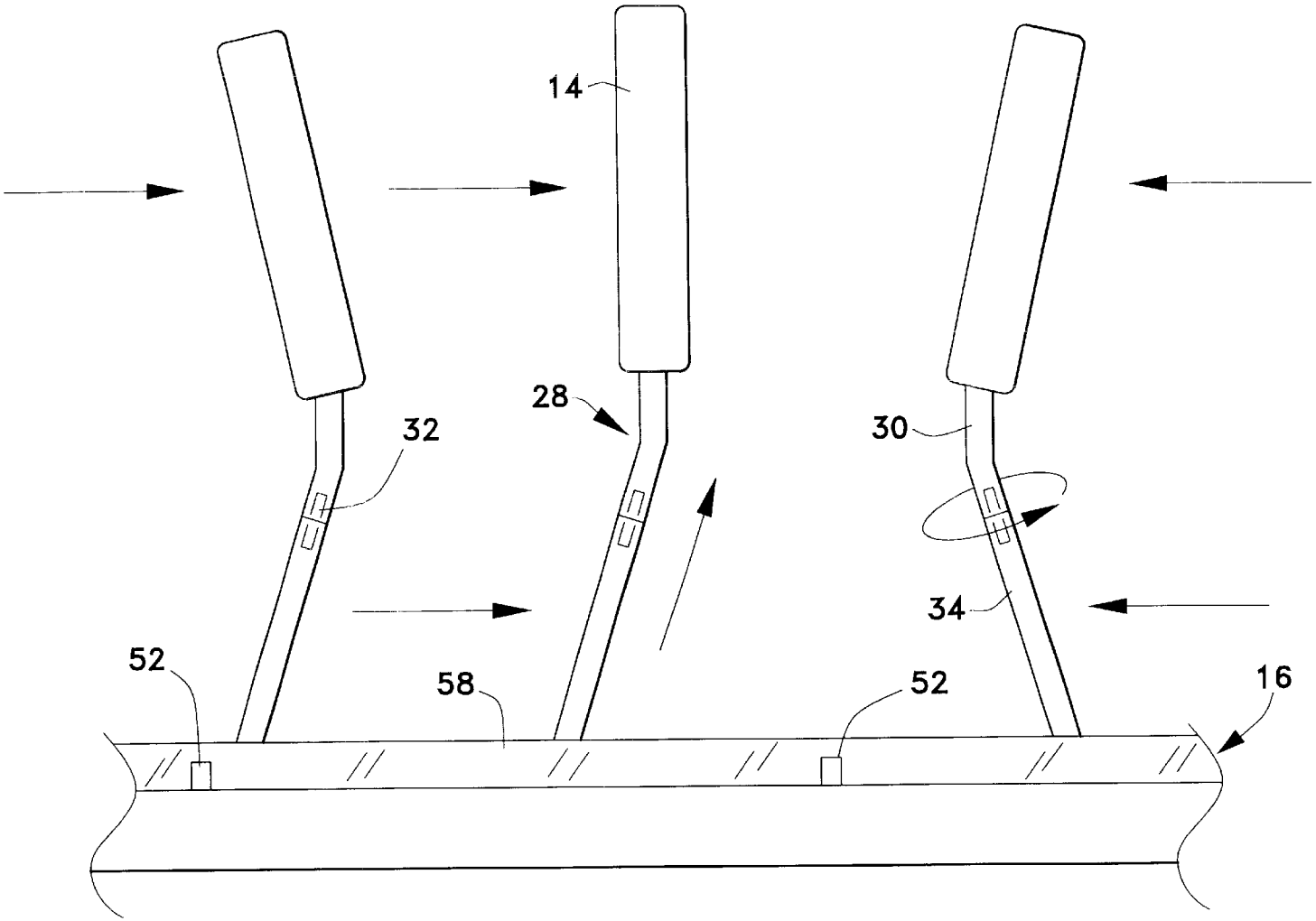
FIG. 3 is a schematic elevational side view of a portion of the platform to illustrate the travel of the blocking/tackling padded dummy from one end to the other with reversal of the dummy's inclined position.

FIG. 3 illustrates the movement of the pad 14 on a bent post 28 supporting the pad 14 having a bent upper post section 30 connected by a pin 32 and abutting a straight upright lower post section 34. The purpose of having the pin 32 in the post 28 is to permit the rotation of the inclined pad 14 to incline at an angle approximately 39° towards the football player 12 beginning his blocking or tackling routine. The post sections 30 and 34 can have their abutting ends secured by any conventional fastening means to prevent twisting of the dummy 14.

Figure 4:
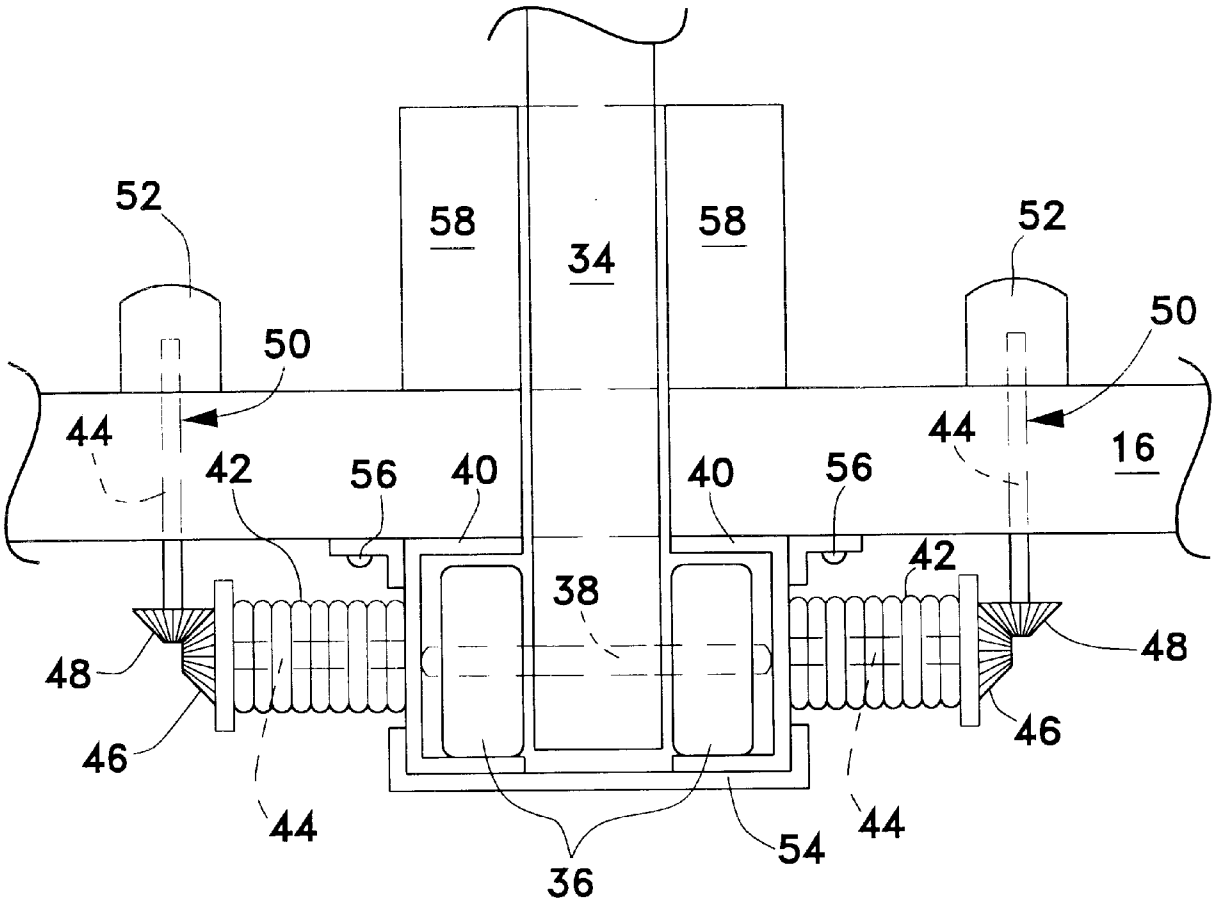
FIG. 4 is a partial elevational end view of the resistance machinery adapted to adjust the resistance of the channels to the wheels supporting the padded dummy.

FIG. 4 shows the lower post section 34 travels in the track 18 on a pair of rollers or wheels 36 located below the platform 16. Each roller 36 is separated by the lower post section 34 and supported by an axle 38. A pair of U-channel means 40 confines the rollers 36. A resistive force means for applying a variable resistance to the channel means 40 is available for adjusting the resistance of the blocking/tackling padded dummy 14, whereby two players at opposite ends of the platform 16 can exert forces to move the blocking/tackling padded dummy 14 from one end 20 to the other end 22 (FIG. 1).

Each U-channel beam 40 is urged against the rollers 36 by a compression spring 42 on a horizontal shaft 44 welded to the channel beam 40. The shaft 44 has a first bevel gear 46 welded on its distal end. A second bevel gear 48 on a vertical shaft 44 which penetrates the platform 16 via a throughbore 50 is connected to a control knob 52. The first and second bevel gears 46, 48, respectively, mesh to allow the player 12 or coach to adjust the resistance suitable for the player, i.e., the second bevel gear 48 of the control knob 52 controls the first bevel gear 46 for adjustment of the expansion and contraction of the compression spring 42. The U-channel beams 40 are confined by a flanged housing 54 attached to the bottom of the platform 16 by fasteners 56.

Each of a plurality of control knobs 52 on the platform 16 are spaced equidistantly along the track 18, and each pair of knobs 16 will be aligned across from each other. The control knobs 52 will have a numbered scale (not shown) to determine the same setting for all the knobs.

A parallel pair of guide rails 58 reinforce the position of the post 28 as the blocking/tackling padded dummy is pushed back and forth by the football players 12.

Thus, it has been shown that a blocking and tackling platform apparatus can enable at least a pair of football players to practice together with the same equipment.

It is to be understood that the present invention is not limited to the embodiments described above, but encompasses any and all embodiments within the scope of the following claims.

I claim:

1. A stationary blocking/tackling platform for football comprising:

a rectangular platform having a first end and a second end, and having a central slotted track spaced from the first end and the second end of the platform;

a blocking/tackling padded dummy having an elongated shape;

a post having a bent upper section, an abutting straight upright lower section, and a pin connecting the upper and lower sections, the padded dummy being mounted on the upper section;

an axle mounted on a distal end of the lower post section and a pair of rollers rotatable on the axle on opposite sides of the lower post section, the axle and rollers being disposed below said slotted track;

a pair of parallel channels, said rollers being rotatable in said channels in order to roll the post along the slotted track; and a plurality of pairs of resistive force means applying a variable resistance to the channel means for adjusting resistance of the post to movement in the slotted track;

wherein two players at opposite ends of the platform can alternately exert forces to move the blocking/tackling pad from one end of the platform to the other end.

2. The blocking/tackling platform according to claim 1, wherein the channel means comprises two parallel channel beams confining the rollers.

3. The blocking/tackling platform according to claim 2, wherein said plurality of pairs of resistive force means comprises a plurality of pairs of compression springs disposed to bias said pair of channels towards each other.

4. The blocking/tackling platform according to claim 3, further comprising a plurality of shafts having a distal end and a first bevel gear on the distal end, each compression spring being mounted on one of said shafts.

5. The blocking/tackling platform according to claim 4, further comprising a plurality of control knobs above the platform, each control knob having a rod attached thereto penetrating the platform and having a second bevel gear attached to the rod.

6. The blocking/tackling platform according to claim 5, where in the second bevel gear of the control knob meshes with the first bevel gear for adjustment of the expansion and contraction of the compression spring.

7. The blocking/tackling platform according to claim 5, wherein the control knobs are evenly spaced on the platform on both sides of the track.

8. The blocking/tackling platform according to claim 1, further comprising a pair of parallel guide rails mounted on the platform for guiding the passage of the blocking/tackling padded dummy along the slotted track.

9. The blocking/tackling platform according to claim 1, further comprising a housing disposed about the pair of channels.

10. The blocking/tackling platform according to claim 1, wherein up to seven platforms are aligned side-to-side.

* * * * *